United States Patent [19]

Laxo

[11] Patent Number: 4,799,331

[45] Date of Patent: Jan. 24, 1989

[54] AUTOMATIC, GRAVITY-POWERED CLOSURE DEVICE

[75] Inventor: Darryl E. Laxo, Novato, Calif.

[73] Assignee: Chevron Research Company, San Francisco, Calif.

[21] Appl. No.: 923,946

[22] Filed: Oct. 28, 1986

Related U.S. Application Data

[63] Continuation-in-part of Ser. No. 681,526, Dec. 14, 1984, abandoned.

[51] Int. Cl.[4] ..... E05F 15/20

[52] U.S. Cl. ..... 49/31; 49/231

[58] Field of Search ..... 49/31, 228, 231, 409–411; 114/119, 122

[56] References Cited

U.S. PATENT DOCUMENTS

| | | | |
|---|---|---|---|
| 509,116 | 11/1893 | Callahan | 49/31 |
| 542,935 | 7/1895 | Montgomery-Moore | 49/31 X |
| 941,428 | 11/1909 | Merrill | 49/31 X |
| 1,392,002 | 9/1921 | Engle | 49/228 X |
| 1,738,792 | 12/1929 | O'Rourke | 49/228 X |
| 3,318,048 | 5/1967 | Odend'Hal | 49/228 X |
| 3,468,282 | 9/1969 | Wintercorn | 114/122 X |
| 3,563,335 | 2/1971 | Holmes et al. | 114/122 X |
| 3,832,754 | 9/1974 | Maertin et al. | 16/152 |
| 4,357,732 | 11/1982 | Hickman | 16/81 |

*Primary Examiner*—Philip C. Kannan

*Attorney, Agent, or Firm*—S. R. LaPaglia; E. J. Keeling; V. A. Norviel

[57] ABSTRACT

A device is described for the automatic closing of openings on a floating structure whereby the need for human or manual intervention is eliminated. Once the floating structure is subjected to tilting (heeling), lateral, or other accelerating forces, an unstable mass is used as a triggering device to remove a block from interfering with the path of the closure. The closure rolls down a ramp and covers an adjacent opening to seal it, thus preventing uncontrolled flooding or fire from spreading within the structure.

1 Claim, 3 Drawing Sheets

NEGATIVE ROLL

MUST HAVE
$\phi - \theta > 0$
FOR DOOR TO
MOVE DOWN
RAMP

POSITIVE ROLL $\phi + \theta > 0$
IN ALL CASES

AUTOMATIC, GRAVITY-POWERED CLOSURE DEVICE

This application is a continuation-in-part of U.S. Ser. No. 681,526, filed Dec. 14, 1984, now abandoned.

FIELD OF THE INVENTION

The present invention generally relates to closure devices. Here, the detailed description recites an automatic, gravity actuated, closure apparatus.

BACKGROUND OF THE INVENTION

There are certain situations where the closure of an opening is important for reasons of safety, i.e., to prevent the spread of a hazardous condition (such as fire or flooding) from one area to another. During these emergency situations it has been recognized that a door should be able to close off an opening without the need of a power system because it, or the emergency detection device that initiates the power system, may become non-functional during the emergency itself. It is also desirable to eliminate the need for manned intervention because the hazardous condition may not give workers or occupants enough time to react to the situation.

This is especially true of offshore vessels such as oil drilling or production platforms. Offshore oil platforms are susceptible to storms, flooding, fire, etc. and are especially vulnerable because of their inaccessibility and potential for great loss due to the sinking of the entire vessel. To illustrate this point, there have been two recent sinkings of floating offshore drilling platforms, the Alexander Keeland, in 1980, and the Ocean Ranger, in 1982. In both cases, unclosed openings contributed to uncontrolled flooding of these vessels. Generally, what happens is that some event such as an impact or storm causes heeling (listing of the vessel) and localized flooding which, due to the network of intercommunicating passages, accelerates both the heeling and flooding. The result of this additive relationship is that the vessel rapidly sinks.

To ensure that passageways will be closed during these emergency situations, it is necessary to invent a device that is free from the limitations of both the power assisted or manual intervention methods. The present invention remedies this problem by using gravity to move the closure over the opening. By doing this, the deficiencies inherent in power assist and manual intervention are eliminated. Patented examples of gravity assisted closure devices are U.S. Pat. Nos. 4,357,732 and 3,832,754. U.S. Pat. No. 4,357,732 discloses an automatic door closure kit that may be mounted on an existing sliding glass door. U.S. Pat. No. 3,832,754 shows self actuating door hinges that operate by gravity.

Consequently, it is an object of this invention to create a door closure that will operate without the need for manned intervention or a power source. It is another object of this invention to develop a door closure device that is actuated by gravity. It is another object of this invention to develop a door closure device that will restrict hazardous conditions such as fire and flooding to a localized compartment.

SUMMARY OF THE INVENTION

The present invention involves a device that is used to close off an opening. This closure mechanism is adapted for use in offshore oil drilling or production structures and is capable of operating without a separate power source or manual intervention. The device is both powered and triggered by gravity to close off an opening, such as a passageway, when the structure heels (tilts) or accelerates beyond a certain degree (due to crash, flooding, etc.). When this activation angle has been exceeded (but before the heeling angle approaches or equals the ramp angle) an unstable mass is upset which causes a linkage mechanism to remove a block from holding the closure on a ramp. The ramp is set at an inclined angle to provide the gravity power necessary to move the closure, and the closure is mounted on rollers to allow it to freely move down the ramp. Once the closure is in place, a self-locking mechanism latches it to localize and prevent the spread of the hazardous condition that set it off initially.

DETAILED DESCRIPTION OF THE INVENTION

Figure 1:
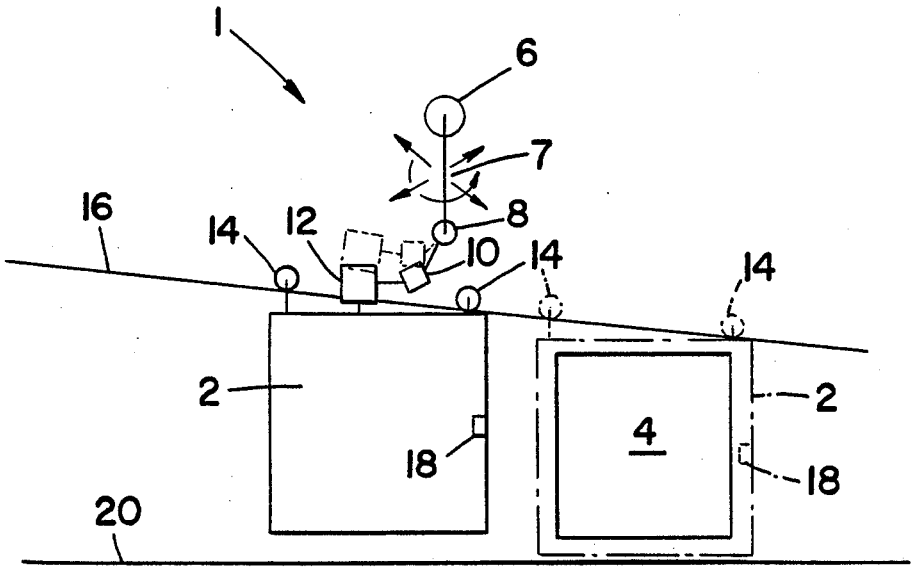
FIG. 1 shows a schematic example of the door closure device in the ready state and also in phantom as it is closed over the door opening.

The present invention uses gravity to move a closure over an opening. Referring now to the drawing, FIG. 1 shows an automatic door closure 1. Elements of the device that trigger or set it into motion include a mass 6 that is acted on by heeling or acceleration (i.e., a crash) which is operational from all directions. Connected to that is a pivot 8 (which can be adjusted to retain a lever 7 in a vertical mode when subjected to normal operating heel and acceleration), a block linkage 10, and a block 12. The block 12 holds a closure 2 onto an angled ramp 16 in the untriggered mode where it is supported by one or more rollers 14. An opening 4 is positioned on the down slope of the ramp 16 and both the closure 2 and the opening 4 are fitted with a latch 18. To reiterate, the closure 2 is held in the ready position by a blocking device 12, and is connected to an unstable mass 6 by a linkage 10. This mass 6 is on the end of a vertical lever 7 which is mounted in an adjustable resistant pivot 8.

The device 1 operates in the following manner. When the platform is subject to a heeling motion or acceleration that is beyond the normal amount (this is the activation or actuation angle, and what is considered normal may be subject to adjustment), the mass 6 falls over and uses the length of the lever 7 to actuate the linkage 10. The linkage 10 removes the block 12 which normally holds the closure 2 to the ramp 16. Once this block 12 is removed, the closure 2 is allowed to move down the inclined ramp 16 on the rollers 14.

Figure 2:
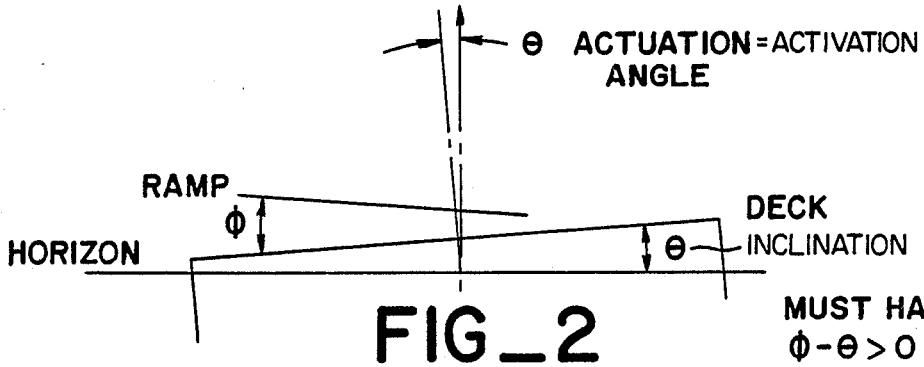
FIG. 2 is an illustration of the relationship between the deck, ramp, and horizon when the platform lists (or heels) in a direction that reduces the effective ramp angle.
Figure 3:
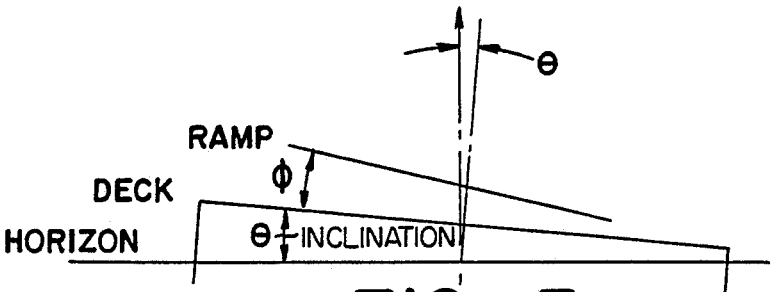
FIG. 3 is an illustration of the relationship between the deck, ramp, and horizon when the platform lists (or heels) in a direction that increases the effective ramp angle.

The effective ramp angle (the angle formed by the ramp and the horizon) must exceed the activation angle (the angle formed by a line perpendicular to the horizon and the point of activation) to allow the closure 2 to roll. The activation angle is that angle of tilt or heeling that trips the unstable mass when the structure encounters a hazardous tilting condition. The closure will be set into motion when the activation angle has been exceeded, but before the heeling angle approaches or equals the ramp angle. If the heel angle is allowed to equal or exceed the ramp angle (so that the ramp angle approaches the horizontal) before the activation angle is reached the device will not work as there will be no gravitational power to force the closure 2 into place. This will happen if the platform undergoes a negative roll (as shown in FIG. 2) which will "flatten out" the ramp angle with respect to the horizon. When the platform rolls in this direction the activation angle will be set at a point that will trip the device before the ramp angle gets too close to the horizon to power the closure over the opening. Obviously this is not a consideration in a positive roll situation (see FIG. 3) where the ramp angle is increased to provide even more gravity power.

Figure 4:
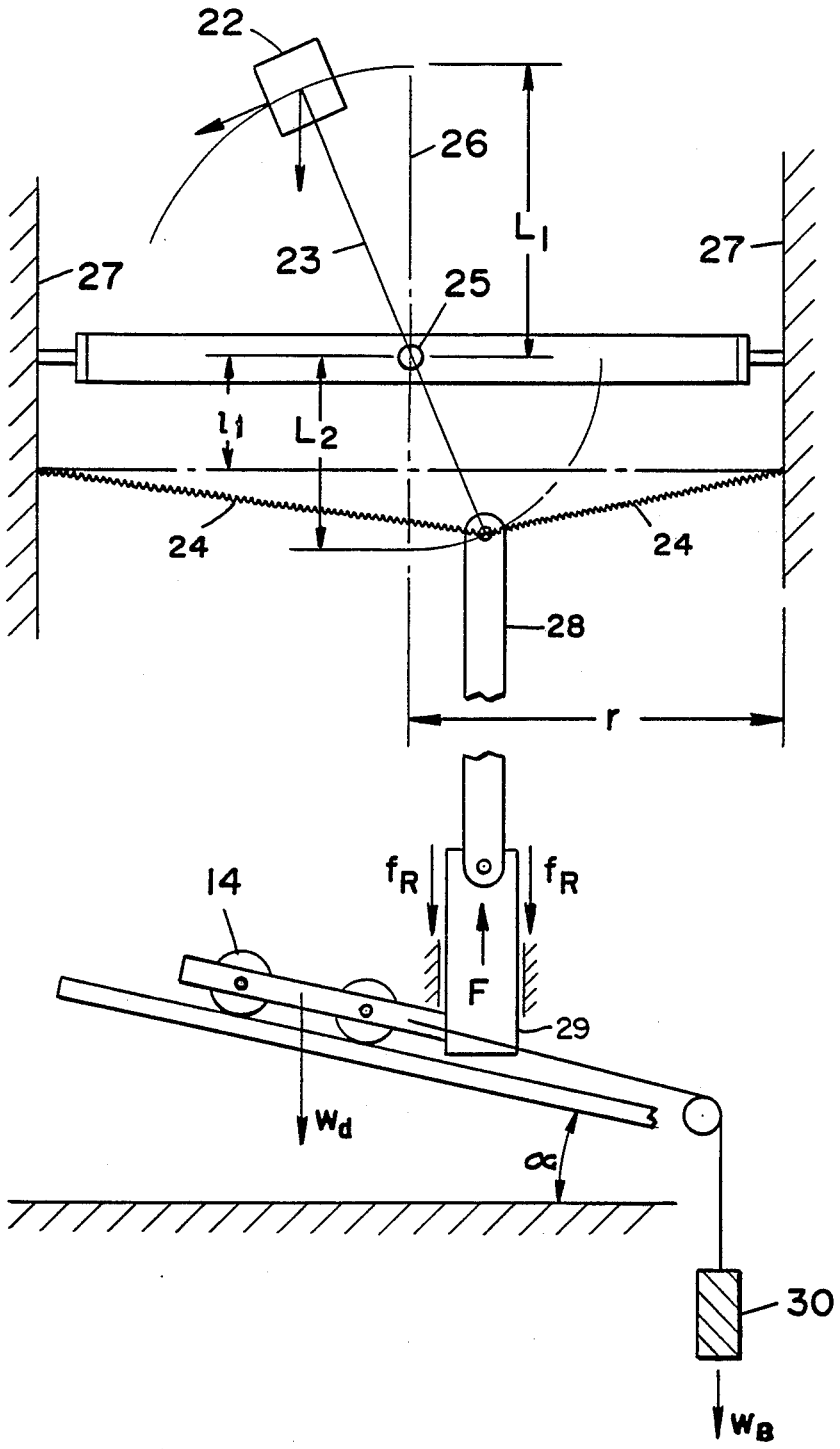
FIG. 4 is a schematic diagram of the trigger device.

A trigger device is shown in greater detail in FIG. 4 which allows the door to close even if the heel angle exceeds the ramp angle in a negative roll situation, by the addition of the weight 30.

This particular arrangement consists of a weight 22, a moment arm 23, three (at least) radially mounted compression springs 24, a gimbelled pivot 25, which allows tilting in any direction about the vertical axis 26, mounted in a rigid frame 27. The frame is attached to the floating structure with the axis of the arm vertical. The lower end of the arm 23 is attached to a linkage 28. This linkage is attached to the release block 29, which is holding the rollers 14 in the open, ready position.

As the floating structure heels, the weight 22 is moved away from the vertical, and a moment about the pivot point is created. That moment (M) is resisted by the increased compression of the spring(s) opposite the weight until a point is reached at which the resultant of the combined overturning force and the spring force changes direction from downward to upward. This resultant force then assists in further offsetting the weight 22, and pulling upward on the linkage 28 to release the door.

Figure 5:
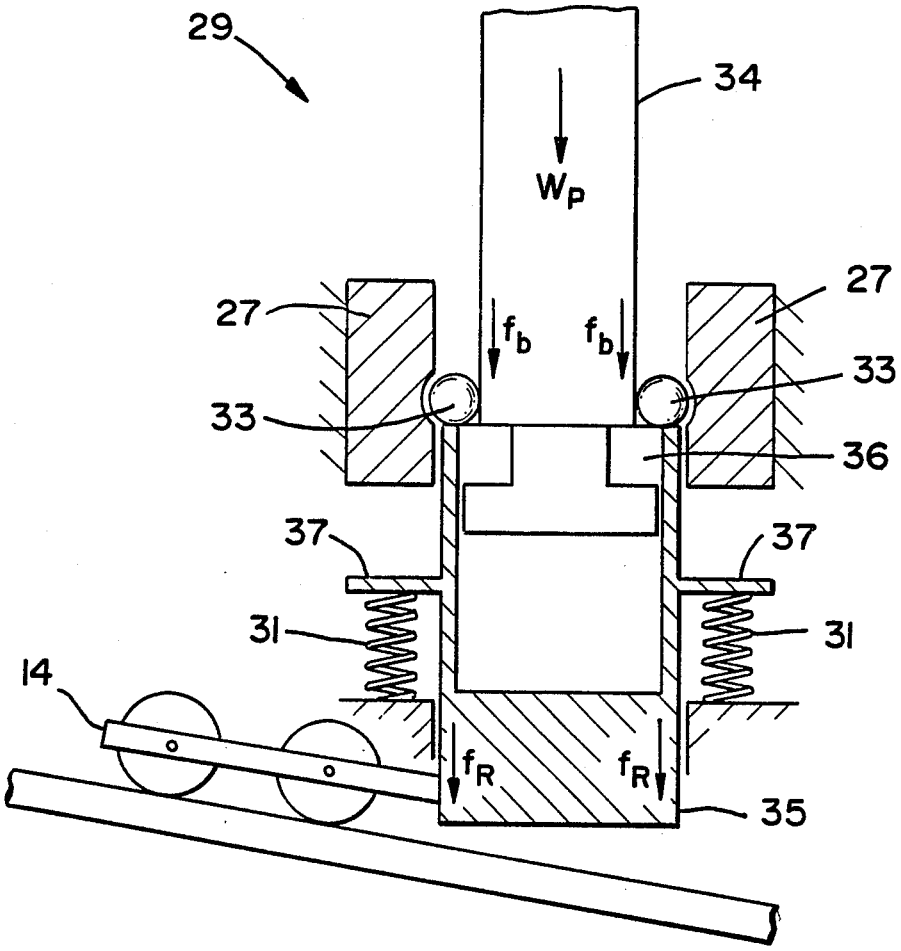
FIG. 5 is a schematic diagram showing details of the release mechanism.

Further details of the release block 29 in the preferred embodiment are shown in FIG. 5. As shown, this release block arrangement minimizes the effect of the door weight and angle of heel of the vessel.

The locked position is shown. Springs 31 are compressed and bear against shoulders on sleeve 37 which in turn bears against balls 33. Balls 33 are held in place with frame 27, trigger pin 34, and sleeve 35, the balls being in a groove in the frame. The sleeve 35 holds the rollers 14 in place. The spring constant ($K_R$) and initial compression of springs ($X_R$) are sufficient to overcome the friction between the rollers and release block regardless of the angle of heel.

When the angle of heel reaches the release angle, the pivoted weight generates enough force to pull the trigger pin up to the point where a ball receiving slot 36 aligns with the balls 33. At this point the balls are pushed into the ball receiving slot by the force resulting between the sleeve and the frame through the balls. As the balls move into the slot, the sleeve 35 is free to move upward due to the force of springs 31. This moves the release block out of the way of the rollers, and the door is able to roll down the ramp to its closed position.

The angle of release, and the force available for release, can be set by adjusting the following parameters:

(a) mass of the weight 22 and the door block 35
(b) length of the weight arm $=L_1$
(c) length of the spring arm $=L_2$
(d) pivot to spring distance $=l_1$
(e) spring constants $=K_1$ and $K_R$
(f) initial compression of the springs 24 and 31 $=x_i$ and $X_R$
(g) frame radius $=r$
(h) trigger pin weight $=W_p$
(i) ball angle $=R$.

The force (F) needed to push the block away and, therefore, release the door will be determined by the coefficient of friction of the block ($f_R$), the ramp angle ($\gamma$), and the weight of the door ($W_d$). This force is provided by the spring(s) 31 ($K_R$).

Table 1 illustrates the characteristics of a trigger device that would have an activation angle of approximately 10 degrees for a door weighing 1000 lbs.

TABLE 1

Calculated Triggering Device Characteristics

Door weight: 1000 lbs.
Activation angle: 10 degrees
Release weight: 100 lbs.
Coefficient of friction between release block and rollers ($f_R$): 0.02
Arm length ($L_1$): 24 in.
Arm length ($L_2$): 2 in.
Pivot to spring attachment distance ($l_1$): 1.5 in.
Spring constants ($K_1$): 60 lb/in.
Friction in pivot, etc.: Assumed to be negligible
Trigger pin weight ($W_p$): 17 lbs
Ball angle (R): 30 degrees
Release spring constant ($K_R$): 100 lb/in.
Precompression ($X_R$): 1 in.

Several characteristics of the above-described triggering device are worth noting. First, the release angle as calculated above assumes that the ship has heeled at a very slow rate, i.e., very little momentum is developed by the release weight. If the ship heels at a fast rate, a significant amount of momentum will be developed by the weight, and will release the door before the above-described activation angle is reached. Therefore, if the ship has a sudden collision, the doors will close even if the activation angle is not reached. It should also be noted that a door assist weight 30 can be attached to the rollers 14. This will further decrease the dependency of the release angle on the direction of the ship's heel, and will allow the door to close even if the ship heels securely to the left. Finally, it should be noted that the coefficient of friction between the release block and the rollers can be adjusted and/or minimized if necessary by inserting bearings between the release block and the rollers.

A guidance or restraining track (not shown) may be added to prevent the closure 2 from swinging out when the platform heels about the axis of the ramp 14. The track may also be used to maintain the closure 2 in contact with the opening 4 and latch 18 at the time or place of latching. The closure 2 rolls down the ramp 16 until it is stopped at a pre-determined spot in front of the opening 4. At this point, the opening 4 is completely sealed off, and the closure 2 is fixed in position by a self-locking latch 18. This effectively localizes the hazard, and prevents it from spreading to other portions of the platform or vessel.

As stated above, an opening on a vessel, such as an off-shore structure, may be sealed off when that vessel undergoes tilting or heeling to a degree that may be hazardous. The opening is automatically closed without the aid of human intervention or need for an electrical or other power source. The invention functions by gravity when the platform tilts either with the ramp or against it (i.e., side to side), and also when it tilts from front to back. Consequently, the previous deficiencies inherent in other current systems have been eliminated.

Although the invention has been described in detail with reference to a particular illustrative embodiment, it will be understood that all other variations and modifications are possible within the same inventive concept. Therefore the present invention is to be limited only by the appended claims and not by reference to any of the above embodiments.

What is claimed is:

1. A gravity actuated automatic closure device, comprising:

a closure for sealing an opening, said closure being roll mounted above said opening;

means for holding said closure in a ready position; and means for disengaging said holding means said means for disengaging further comprising:

(a) a pivotally mounted moment arm connected at its first end to said means for holding;

(b) a release weight at a second end of said moment arm; and (c) a plurality of compression springs radially attached to said moment arm below a pivot point on said moment arm.

* * * * *